US006115856A

United States Patent [19]

Najar

[11] Patent Number: 6,115,856

[45] Date of Patent: Sep. 12, 2000

[54] BARBER OR BEAUTICIAN'S CHAIR BACK INCORPORATING CERVICAL LORDOTIC SUPPORT

[76] Inventor: Michael Najar, 2407 Old Mill Rd., Spring Lake Heights, N.J. 07762

[21] Appl. No.: 09/349,957

[22] Filed: Jul. 9, 1999

[51] Int. Cl.[7] ..... A45D 44/10

[52] U.S. Cl. ..... 4/523

[58] Field of Search ..... 4/515–519, 523; 297/396

[56] References Cited

U.S. PATENT DOCUMENTS 2,988,753 6/1961 Corvelli ..... 4/523

4,167,048 9/1979 Williams ..... 4/517

5,799,344 9/1998 Najar ..... 4/523

*Primary Examiner*—Charles E. Phillips

*Attorney, Agent, or Firm*—Clifford G. Frayne

[57] ABSTRACT

An anatomically correct chair back for a barber of beautician salon chair for anatomically correctly positioning the head and neck when the individual is placed in a reclining position, the apparatus being a chair back incorporating an arcuate surface complimentary with the normal cervical lordotic curve of the individual's spine, the chair back providing planar and lateral support to the neck area of the individual.

2 Claims, 3 Drawing Sheets

BARBER OR BEAUTICIAN'S CHAIR BACK INCORPORATING CERVICAL LORDOTIC SUPPORT

BACKGROUND OF THE INVENTION

1. Field of the Invention

The present invention relates to the field of neck and head supports, and in particular, a cervical lordotic support incorporated in a barber or beautician's chair back to support the neck and head when positioned in a reclining mode proximate to a sink for shampooing, rinsing, permanents, dying and the like.

2. Description of the Prior Art

Both men and women utilize the services of barbers and beauticians in order to have their hair styled, shampooed and rinsed, dyed, or to have a permanent performed. A procedural element of all the aforementioned is the reclining of the individual, rearwardly, in the barber or beautician's chair, so that the chair can be positioned over an adjacent sink for rinsing with water.

This positioning of the individual is often awkward and uncomfortable in that the person's head is oftentimes positioned lower than the chest cavity, and that portion of the person's head having active hair follicles, must extend over the sink. Support therefore must be placed in the non-hair growing region of the neck.

Various attempts have been made to mollify the awkwardness and uncomfortableness of this positioning. These attempts include U.S. Pat. No. 1,244,715 to Dozier et al. which attempts to move the support upwardly from the sink; U.S. Pat. No. 727,452 to Romans, which suggests an alternative form of headrest; U.S. Pat. No. 2,803,834 to McClung for another form of extension apparatus; U.S. Pat. No. 4,167,048 to Williams for a support and runoff collection apparatus; U.S. Pat. No. 4,327,452 to Swatzell which illustrates a neck support pad which secures directly to the lip of the sink; U.S. Pat. No. 4,385,408 to Rhodes which again discloses another cushioning pad which is secured to the sink.

All of the aforementioned attempt to provide an alternative form of support, however, all are found lacking in that none provide an anatomically correct support designed to conform to the normal cervical lordotic curve which provides for support to the upper mid back region extending upwardly to support the base of the head and neck. This contour allows the back, shoulder and neck muscles to relax and maintain the neutral position of the neck curve preventing extension which is a common cause of neck, shoulder and head pain. Applicant has received U.S. Pat. No. 5,799,344 for a neck support cushion for attachment to barber and salon chairs, however, the instant application incorporates the cervical lordotic curvature in the chair back directly.

It is of particular relevance in light of recent case studies, some of which are reported in the April, 1993 issue of the Journal of the American Medical Society, Volume 269, number 16. These studies appear to indicate that certain individuals are at risk when placed in such a position, for potential stroke or strokerelated injuries. This appears to be attributable to the reclined position, extension of the neck and possible movement of the head in a back and forth position during the treatment.

Therefore, a need exists for a cervical correct support which provides planar and lateral support at the appropriate location when an individual is so positioned. Applicant's invention addresses this issue with an apparatus which is cervically correct and which is incorporated in the chair back of existing barber or beautician's chairs.

SUMMARY OF THE INVENTION

An anatomically correct chair back for a barber or beautician's salon chair for anatomically correctly positioning the head and neck when the individual is placed in a reclining position, the apparatus being a chair back incorporating an arcuate surface complimentary with the normal cervical lordotic curve of an individual's spine, the chair back providing planar and lateral support for the neck area of the individual.

OBJECTS OF THE INVENTION

An object of the present invention is to provide for a novel chair back for a barber or beautician's salon chair which provides cervical lordotic support.

A further object of the present invention is to provide for a novel chair back for a barber or beautician's salon chair which will support the neck and head in a relaxed, comfortable position when reclined, thereby reducing the risk of cervical strain, sprain, neck injuries, pinched nerves, headaches and muscle spasms.

A still further object of the present invention is to provide for a novel chair back for a barber or beautician's salon chair which reduces the risk of diminished vertebral or carotid blood flow to the brain.

A still further object of the present invention is to provide for a novel chair back for a barber or beautician's salon chair which limits the ability of the barber or beautician to hyperextend or rotate the individual's head and neck.

BRIEF DESCRIPTION OF THE DRAWINGS

These and other objects of the present invention will be more apparent particularly when taken in view of the accompanying illustrations wherein.

DETAILED DESCRIPTION OF THE DRAWINGS

Figure 1:
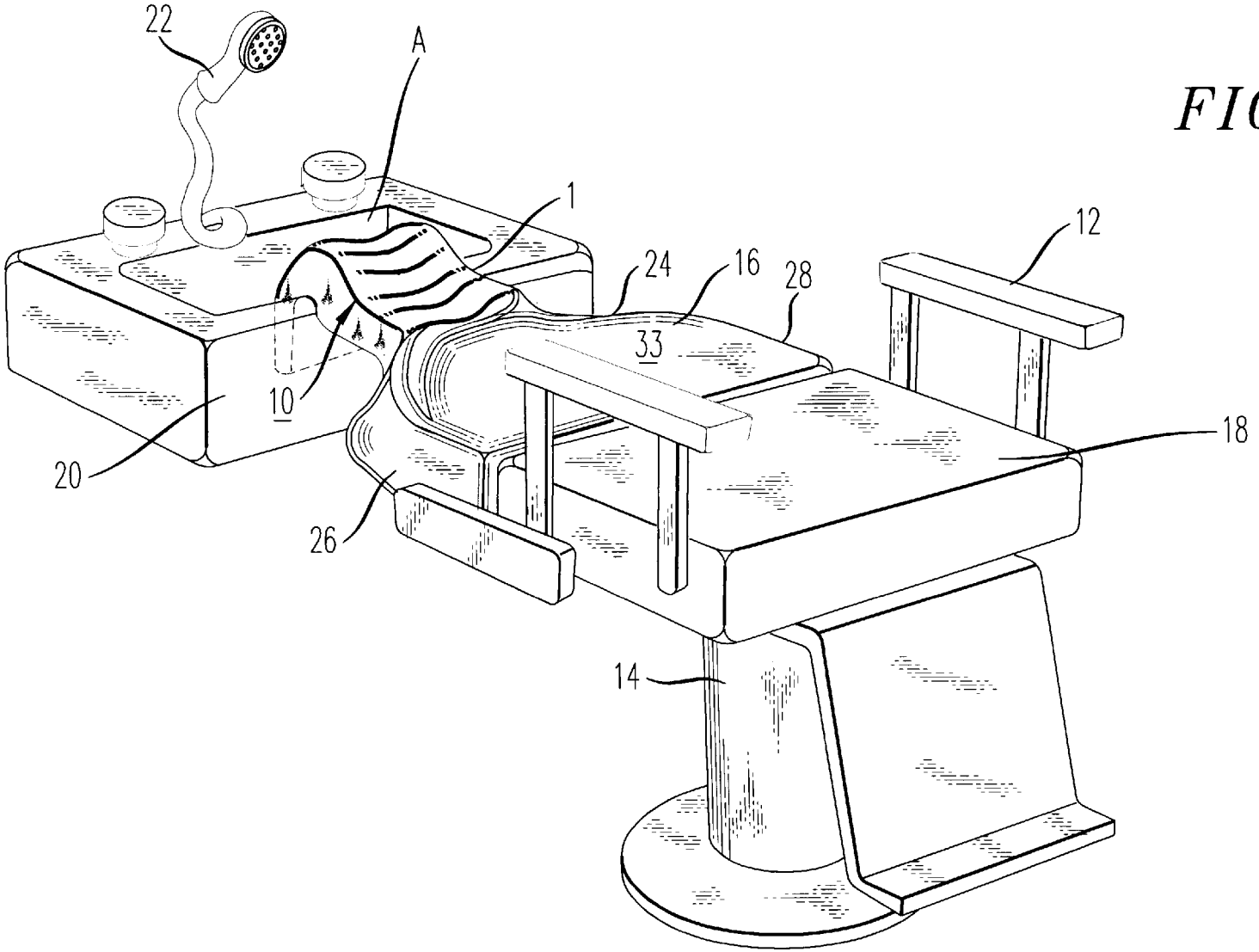
FIG. 1 is a perspective view of a barber or beautician chair incorporating the present invention.

FIG. 1 illustrates the incorporation of neck support 10 into a barber or beautician's chair 12 which chair is normally securely mounted to the floor by means of a pedestal 14. The chair 12 is designed to swivel 360 degrees about the axis of pedestal 14. Additionally the rear or back support portion 16 of chair 12 can be lowered to a desired angle with respect to its relationship with the seat portion 18. Back support 16 is typically lowered in order to place the individual's head in proximity to a wash basin or sink 20, wash basin or sink 20 having the necessary attachments 22 to rinse the hair of the individual or to perform other hair treatment tasks. As illustrated in FIG. 1, neck support 10 is incorporated into chair back 16, proximate to its upper end 24 so as to provide support for the upper spine, neck and rear head portion of the individual.

Figure 2:
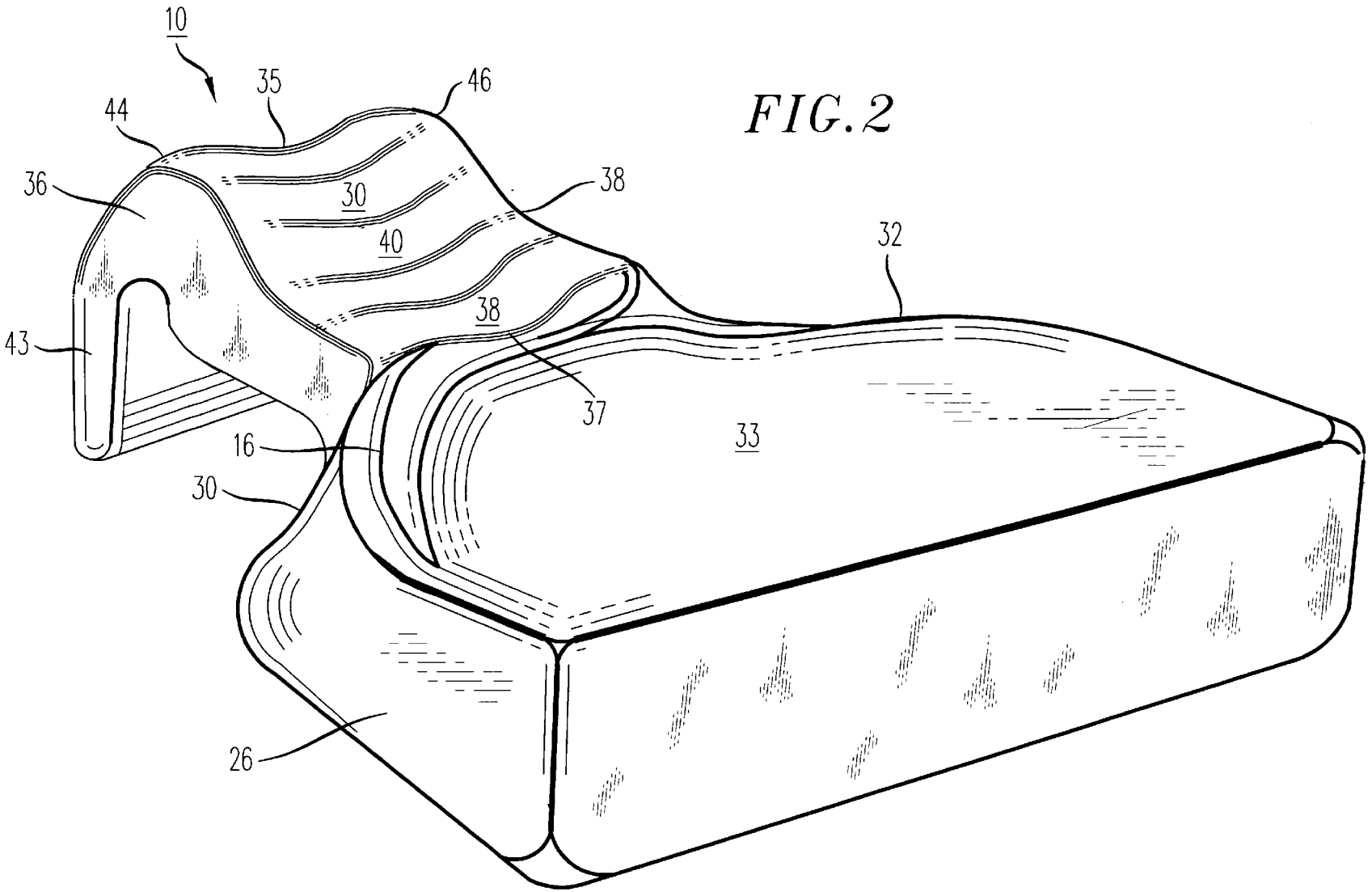
FIG. 2 is a perspective view of area A of FIG. 1.

FIG. 2 is an enlarged perspective view of area A of FIG. 1. In this view, it can be seen that chair back 16 is formed of side walls 26 and 28 which taper inwardly or convergently at 30 and 32 respectively and terminate at the upper end 24 of chair back 16 in the form of a cervical lordotic cushion 10 which is incorporated and formed as one piece with the chair back 16.

Neck support cushion 10 is formed with an arcuate upper surface 30 extending from chair back surface 33 to crest 35 cooperable with the cervical lordotic portion of the spine, upper surface 30 being an extension of the front surface 33 of chair back 16 and extending upwardly from the top 24 of chair back 16. The upper surface 30 of the neck cushion 10 is also arcuate in a transverse direction between side walls 36 and 38.

From the front 37 of neck support 10 to the crest 35 of neck support 10, the upper surface 30 commences with a gentle upward slope in sector 38, the slope increasing in sector 40 and reaching an apex at crest 35 at which point the arcuate slope descends and forms a tongue 43 cooperative with wash basin or sink 20. The arcuate surface of upper surface 30 of sectors 38, 40 and 42 correspond to the normal cervical lordotic curve of the individual spine which commences in the upper back region of an individual, medial the shoulder blades and extends through the neck region to the base of the skull.

In addition to this cervical lordotic curvature, upper surface 30 is bilateral with respect to the longitudinal axis of neck support 10 running from front 37 to crest 35. The second curvature is designed to support the neck and cervical areas so as to prevent any radical rotation of the neck and head. The second curvature which runs transverse on neck cushion 10 has its respective apexes 44 and 46 proximate to crest 35. The curvature or slope descends from these apexes downwardly and mediately until it melds into sectors 35, 38, and 40 of the longitudinal curvature of neck support 10. Transverse curvature depends mediately towards the longitudinal axis, the greatest distance proximate to the apex 44 and 46 and decreases its downward medial slope toward the longitudinal axis as it approaches front 37 and crest 35. This transverse curvature therefore defines a valley or depression which commences with a low elevation in sector 38 having increasing elevation through sector 40 to crest 35. This transverse curvature defines two mounds on opposing sides of the valley or depression defined by apexes 44 and 46 which provide side to side resistance and thus prevents any radical or sudden rotation of the neck or head since the depression or valley defines the location wherein there would be positioned the nape of the individual's neck.

Tongue 43 depends downwardly from the crest 35 of neck support 10 and it is designed to engage the rim of sink 20. Typical barber shop and salon sinks resemble a normal sink found in a home or residence with the exception that the front rim has a downward curvature or depression which also protrudes outwardly from the sink. It is in this depression that normally the nape of the individual's neck would rest during the salon or barber treatment and it is this hard enameled surface which may cause discomfort to the patron and/or physiological problems. Tongue 43 is designed to engage the inner surface of the sink proximate this depression so as to properly position the patron, and the patron's neck in a cushioned position for the hair or salon treatment.

Figure 3:
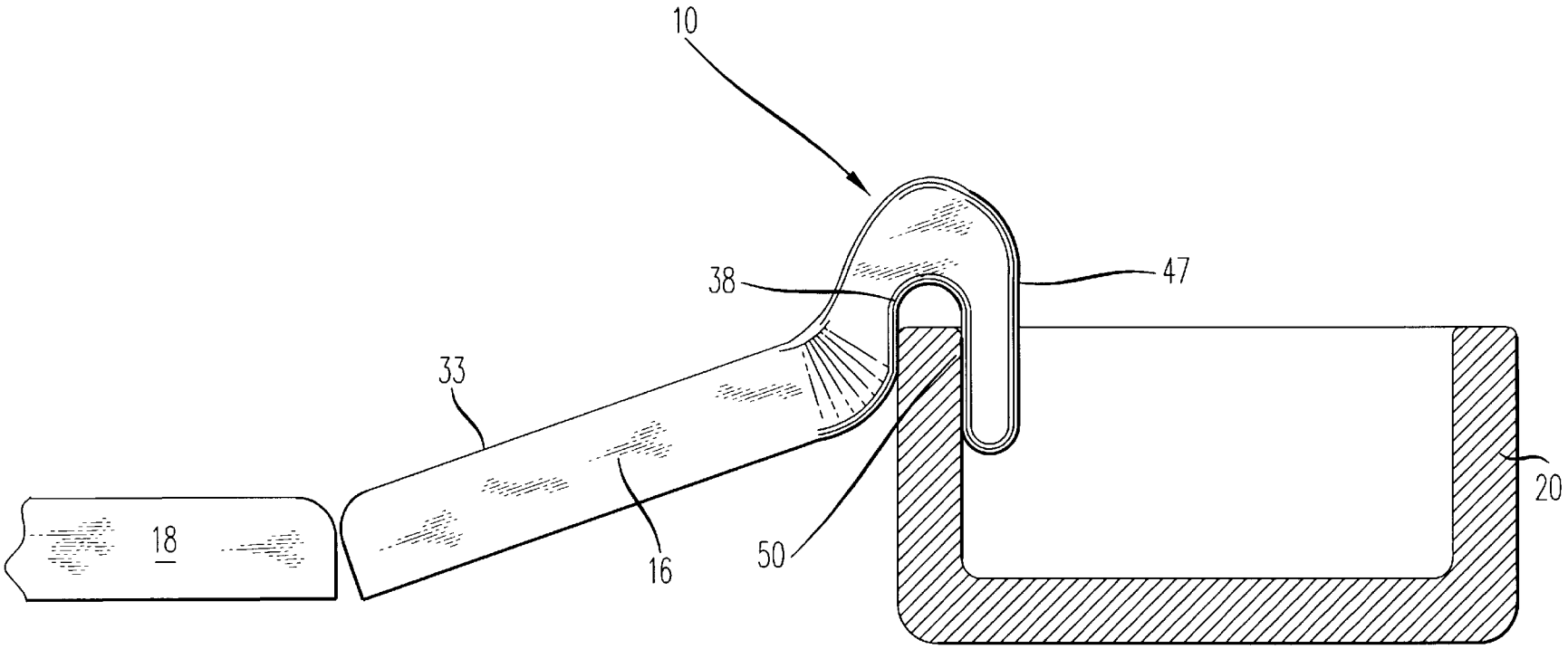
FIG. 3 is a side view of the present invention with a cut away portion of the sink.

FIG. 3 is a side view of area A of FIG. 1 further illustrating the manner in which neck cushion 10 is incorporated into chair back 16 such that it provides for the necessary cervical lordotic support. Tongue 43 overlaps the front rim 50 of wash basin or sink 20 so as to properly position the patron's head while still providing the proper support to the neck and spine and eliminate the problem heretofore stated. By this positioning, the barber or beautician can perform the necessary hair treatment insuring that the water, dye or other fluids drain into the sink. In this regard, the neck cushion would be constructed or covered with a non-porous water repellant material which could be easily cleaned between patrons.

While the present invention has been disclosed with respect to the preferred embodiment thereof, it will be recognized by those of ordinary skill in the art that many modifications and changes can be performed without departing from the spirit and scope of the invention. Therefore it is manifestly intended that the invention be limited only by the scope of the claims and the equivalence thereof.

I claim:

1. A chair back support member for a barber chair or a beautician chair incorporating an anatomically correct cervical lordotic support, said back support member comprising:

a back support member hingeably rotatably securable to a seat member for rotation from an upright position to a reclined position for access to a sink, said back support member having a front face, a rear face, opposing sides, a bottom and a top surface;

an anatomically correct cervical lordotic support integrally formed on said top surface of said chair back member and extending outwardly therefrom, said anatomically correct cervical lordotic support formed with an upper surface extending from said top of said chair back member to a terminus crest, said upper surface having a first arcuate surface preformed to said cervical lordotic curve of said spine extending from said top of said chair back member to said terminus crest, said upper surface having a second arcuate surface extending transverse between opposing side walls, said second arcuate surface being complimentary to the rear circumference of the individual's neck, said second arcuate surface tapered medially in depth from said terminus crest of said cervical lordotic support member to said front edge of said cervical lordotic support member, said anatomically correct cervical lordotic support complimentary to the cervical lordotic curve of an individual's upper spine and neck.

2. The chair back support member in accordance with claim 1 wherein said cervical lordotic support member is formed with a depending tongue member extending downwardly from said terminus crest, said depending tongue member contoured to engage the inner surface and front rim of said sink so as to provide additional support and proper positioning of said individual's upper spine and neck.

* * * * *